US009677020B2

(12) United States Patent
Fang et al.

(10) Patent No.: US 9,677,020 B2
(45) Date of Patent: Jun. 13, 2017

(54) HYDROCARBYL SOLUBLE QUATERNARY AMMONIUM CARBOXYLATES AND FUEL COMPOSITIONS CONTAINING THEM

(71) Applicant: Afton Chemical Corporation, Richmond, VA (US)

(72) Inventors: Xinggao Fang, Midlothian, VA (US); Scott D. Schwab, Richmond, VA (US); Daniel Taylor, Fredericksburg, VA (US)

(73) Assignee: Afton Chemical Corporation, Richmond, VA (US)

( * ) Notice: Subject to any disclaimer, the term of this patent is extended or adjusted under 35 U.S.C. 154(b) by 324 days.

(21) Appl. No.: 14/315,302

(22) Filed: Jun. 25, 2014

(65) Prior Publication Data

US 2015/0376524 A1 Dec. 31, 2015

(51) Int. Cl.

| | |
|---|---|
| ***C10L 1/22*** | (2006.01) |
| ***C10L 1/224*** | (2006.01) |
| ***C10L 1/222*** | (2006.01) |
| ***C10L 1/232*** | (2006.01) |

(52) U.S. Cl.

CPC ..... *C10L 1/224* (2013.01); *C10L 1/2222* (2013.01); *C10L 1/232* (2013.01); *C10L 2230/085* (2013.01); *C10L 2230/086* (2013.01); *C10L 2230/22* (2013.01); *C10L 2270/02* (2013.01)

(58) Field of Classification Search

CPC ..... C10L 1/2222; C10L 1/224; C10L 1/232; C10L 2230/085; C10L 2230/086; C10L 2230/22; C10L 2270/02

USPC ..... 44/422

See application file for complete search history.

(56) References Cited

U.S. PATENT DOCUMENTS

| | | | |
|---|---|---|---|
| 4,248,719 | A | 2/1981 | Chafetz et al. |
| 4,892,944 | A | 1/1990 | Mori et al. |
| 5,254,138 | A | 10/1993 | Kurek |
| 5,399,762 | A | 3/1995 | Walker |
| 5,438,034 | A | 8/1995 | Walker |
| 5,641,726 | A | 6/1997 | Walker |
| 5,855,817 | A | 1/1999 | Walker |
| 8,147,569 | B2 | 4/2012 | Barton et al. |
| 2004/0162343 | A1 | 8/2004 | Walker |
| 2007/0155636 | A1 | 7/2007 | Koishikawa |
| 2007/0191605 | A1 | 8/2007 | Raab |
| 2008/0307698 | A1 | 12/2008 | Barton et al. |
| 2013/0104826 | A1 | 5/2013 | Burgess et al. |
| 2013/0118062 | A1 | 5/2013 | Fang et al. |

FOREIGN PATENT DOCUMENTS

| | | | | |
|---|---|---|---|---|
| EP | 0293192 | A1 | 11/1988 | |
| JP | 04282350 | A1 | 10/1992 | |
| JP | 11193391 | A1 | 7/1999 | |
| RU | 2226206 | C2 | 3/2004 | |
| WO | 2006135881 | A2 | 12/2006 | |
| WO | 2013000997 | A1 | 1/2013 | |
| WO | 2013070503 | A1 | 5/2013 | |
| WO | WO 2013070503 | A1 * | 5/2013 | ..... C10L 1/1266 |

* cited by examiner

*Primary Examiner* — Latosha Hines

(74) *Attorney, Agent, or Firm* — Luedeka Neely Group, PC

(57) ABSTRACT

A fuel additive composition, fuel composition, method of improving the injector performance of a fuel injected engine, method for preventing or cleaning up deposits in an engine or fuel system, method of reducing wear in a fuel system of an engine, and method of improving the demulsibility of a fuel composition. The fuel composition includes from about 5 to about 300 ppm by weight based on a total weight of the fuel composition of a hydrocarbyl soluble quaternary ammonium carboxylate derived from a quaternary ammonium carbonate and an organic acid.

21 Claims, No Drawings

HYDROCARBYL SOLUBLE QUATERNARY AMMONIUM CARBOXYLATES AND FUEL COMPOSITIONS CONTAINING THEM

TECHNICAL FIELD

The disclosure is directed to a fuel additive compositions and to fuels that include the additive composition that are useful for improving the performance of fuel injected engines, reducing engine wear, improving fuel demulsibility. In particular the disclosure is directed to fuel additive compositions that include hydrocarbyl soluble quaternary ammonium carboxylates and to methods for using the carboxylates in a fuel composition.

BACKGROUND AND SUMMARY

Fuel compositions for vehicles are continually being improved to enhance various properties of the fuels in order to accommodate their use in newer, more advanced engines. Accordingly, the fuel compositions contain additives which are directed to certain properties that require improvement. For example, friction modifiers, such as fatty acid amides, are added to fuel to reduce friction and wear in the fuel delivery systems of an engine. Other additives are included in the fuel compositions to reduce the corrosion potential of the fuel composition and/or improve the conductivity property of the fuel composition. Still other additives are added to the fuel to improve the fuel economy of an engine operating on the fuel. Each of the foregoing additives may be effective to improve a single property of the fuel composition and, in some instances, may adversely affect other properties of the fuel composition. Accordingly, fuel compositions typically include a complex mixture of additives that are selected to cooperate with each other to improve the fuel composition. Some of the additives may be beneficial for one characteristic, but detrimental to another characteristic of the fuel. Accordingly, there is a need for a fuel additive that is effective to improve multiple characteristics of a fuel.

Engine and fuel delivery system deposit is a particularly important problem for modern combustion engines and deposit control additives are used to mitigate this problem. For example, diesel engines suffer deposit in the fuel delivery system. Well known succinimide type detergents offer limited detergency as measured by industry DW10 and XUD9 tests.

Gasoline engines also suffer deposit problems. Commonly known type detergent such as Mannich detergent did not provide sufficient cleaning power.

Quaternary ammonium compounds such as alkoxylated salts have recently been developed as very effective detergents compared to conventional succinimide and Mannich base detergents. Quaternary ammonium compounds are known as is disclosed in U.S. Pat. No. 8,147,569. However highly dangerous ethylene oxides and propylene oxides are required to make such detergents.

Quaternary ammonium compounds through alkylation with dialkyl carbonate are also disclosed in U.S. Pat. No. 8,147,569. However the carbonate anion part of the molecule is susceptible to precipitation and drop out in fuels or additive packages. In addition, the detergency of quaternary ammonium carbonates may still need to be improved.

In accordance with the disclosure, exemplary embodiments provide a fuel additive composition, fuel composition, method of improving the injector performance of a fuel injected engine, method of reducing wear in a fuel system of an engine, and method of improving the demulsibility of a fuel composition. The fuel composition includes from about 5 to about 300 ppm by weight based on a total weight of the fuel composition of a hydrocarbyl soluble quaternary ammonium carboxylate derived from a quaternary ammonium carbonate and an organic acid.

One embodiment of the disclosure provides a method of improving the injector performance of a fuel injected engine. The method includes combusting in the engine a fuel composition comprising a major amount of fuel and from about 5 to about 300 ppm by weight based on a total weight of the fuel composition of a hydrocarbyl soluble quaternary ammonium carboxylate derived from a quaternary ammonium carbonate and an organic acid.

Another embodiment of the disclosure provides a method of reducing wear in a fuel system of an engine. The method includes operating the engine on a fuel composition comprising a major amount of fuel and from about 5 to about 300 ppm by weight based on a total weight of the fuel composition of a hydrocarbyl soluble quaternary ammonium carboxylate derived from a quaternary ammonium carbonate and an organic acid.

A further embodiment of the disclosure provides a method of improving the demulsibility of a fuel composition. The method includes providing as a fuel composition a major amount of fuel and from about 5 to about 300 ppm by weight based on a total weight of the fuel composition of a hydrocarbyl soluble quaternary ammonium carboxylate derived from a quaternary ammonium carbonate and an organic acid.

Another embodiment of the disclosure provides a process of making a hydrocarbyl substituted amido-trialkyl quaternary ammonium carbonate. The process includes reacting an amidodialkylamine with dialkylcarbonate in the mole ratio of amine to carbonate of from about 1:1 to about 1:1.5 at a temperature ranging from about 120° to about 160° C. in a reaction medium substantially devoid of a protic solvent.

Additives of the disclosure may overcome the deficiencies of current known fuel detergents by providing improved detergency and reduced negative impact on fuel demulsibility. In addition, the additive may also be capable of reducing engine wear using both petroleum and ethanol containing gasoline fuels.

An advantage of the compositions and methods described herein is that the additive composition and the fuel composition may not only improve the friction and wear properties of the fuel, but the additive composition may be effective to improve fuel economy, and/or to clean up or prevent deposits on engine parts and in fuel systems for engines at relatively low treat rates.

Another advantage of the fuel additive described herein is that the additive composition may be used at a relatively low concentration in combination with conventional fuel additives to provide enhanced engine performance.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A particularly suitable fuel additive component for improving the operation of internal combustion engines may be made by reacting a tertiary amine of the formula

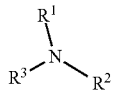

wherein each of $R^1$, $R^2$, and $R^3$ is selected from hydrocarbyl groups containing from 1 to 200 carbon atoms, with a dialkyl carbonate and subsequent reaction of the resulting quaternary ammonium carbonate with an acid or phenol to provide a hydrocarbyl soluble quaternary ammonium carboxylate or phenate respectively. The quaternary ammonium carbonate may also be derived from a tertiary amido amine and a dialkyl carbonate. Regardless of how the hydrocarbyl quaternary ammonium carbonate is made, a key feature of the disclosure is that the resulting quaternary ammonium carbonate is reacted with an organic acid or phenolic compound to provide the hydrocarbyl soluble quaternary ammonium carboxylate or phenate.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Amine Compound

In one embodiment, a tertiary amine including diamines and polyamines may be reacted with a $C_1$ to $C_{54}$ carboxylic acid to form an amido amine and the amido amine may be subsequently reacted with a quaternizing agent. Suitable tertiary amido amine compounds may have a hydrocarbyl linkage, such as an ether linkage between the amido group and the amino group or the tertiary amido amine may be a compound of the formula

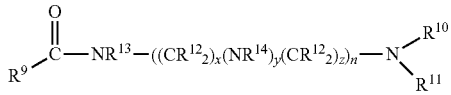

may be used, wherein each of $R^{10}$, and $R^{11}$ is selected from hydrocarbyl groups containing from 1 to 200 carbon atoms, each $R^9$, $R^{12}$, $R^{13}$ and $R^{14}$ may be independently selected from hydrogen or a hydrocarbyl group, x may range from 1 to 6, y may be 0 or 1, z may be 1 to 6, and n may range from 1 to 6. Each hydrocarbyl group $R^9$ to $R^{14}$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amino groups, and the like. Particularly suitable hydrocarbyl groups may be linear or branched alkyl groups. A representative example of an amine reactant which may be amidized and quaternized to yield compounds disclosed herein include for example, but are not limited to, dimethyl amino propyl amine and 2-(2-dimethylamino-ethoxy)ethylamine.

If the amine contains solely primary or secondary amino groups, it may be desirable to alkylate at least one of the primary or secondary amino groups to a tertiary amino group prior to quaternizing. In one embodiment, alkylation of primary amines and secondary amines or mixtures with tertiary amines may be exhaustively or partially alkylated to a tertiary amine, and then converted into a quaternary ammonium carbonate salt.

When the amine has a hydroxyl group, the amine may be converted to an ester amine by reacting the amine with a $C_1$ to $C_{54}$ carboxylic acid. The acid may be a monoacid, a dimer acid, or a trimer acid. The acid may be selected from the group consisting of formic acid, acetic acid, propionic acid, butyric acid, caprylic acid, capric acid, lauric acid, myristic acid, palmitic acid, stearic, arachidic acid, behenic acid, lignoceric acid, cerotic acid, myristoleic acid, palmitoleic acid, sapienic acid, oleic acid, elaidic acid, vaccenic acid, linoleic acid, linoelaidic acid, α-linolenic acid, arachidonic acid, eicosapentaenoic acid, erucic acid, docosahexaenoic acid, and the dimer and trimer acids thereof. When reacted with the amine, the reaction product may be a $C_1$-$C_{54}$-alkyl or alkenyl-substituted ester amine such as a $C_1$-$C_{54}$-alkyl or alkenyl-substituted ester propyldimethylamine.

In another embodiment, the tertiary amine may be a reaction product of a hydrocarbyl substituted succinic anhydride and a tertiary amine of the formula

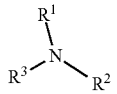

wherein $R^1$, $R^2$, and $R^3$ are defined as above. Suitable tertiary amines include, but are not limited to 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylamino-propylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis-(N,N-dimethylpropylamine), 1-(3-aminopropyl)imidazole, 4-(3-aminopropyl)morpholine, 1-(2-aminoethyl)piperidine, 3,3-diamino-N-methyldipropylamine, 3,3-aminobis(N,N-dimethylpropyl-amine), N,N,N'-trimethyl-N'-hydroxyethyl bisaminoethyl ether, N,N-bis(3-dimethylamino-propyl)-N-isopropanolamine, bis(N,Ndimethylaminopropyl)amine, 2-(2-dimethylaminoethoxy-ethanol, 2-dimethylaminoethyl methyl ethanolamine, or combinations thereof.

Other suitable tertiary amines may include alkanolamines such as triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol, N,N,N'-trimethyl-N'-hydroxyethyl bisaminoethyl ether, N,N-bis(3-dimethylaminopropyl)-N-isopropanolamine, bis(N,Ndimethylaminopropyl)amine, 2-(2-dimethylaminoethoxy-ethanol, 2-dimethylaminoethyl methyl ethanolamine, or combinations thereof. Other amines that may be used include Mannich base amines and ether or carbonyl capped Mannich base amines.

Any of the foregoing tertiary amines may be reacted with a hydrocarbyl substituted acylating agent that may be selected from a hydrocarbyl substituted mono- di- or polycarboxylic acid or a reactive equivalent thereof. A particularly suitable acylating agent is a hydrocarbyl substituted succinic acid, ester, anhydride, mono-acid/mono-ester, or diacid.

Quaternizing Agent

A suitable quaternizing agents may be selected from a carbonic acid diester, such as dimethyl carbonate, ethylmethyl carbonate, diethyl carbonate, di-propyl carbonate, dibutyl carbonate, cyclic carbonates, and the like. A particularly suitable carbonic acid diester may be selected from dimethyl carbonate and diethylcarbonate. The reaction between the tertiary amine and carbonate may be carried out by contacting and mixing the amine with the carbonate in the reaction vessel in the substantial absence of acid or protonating agent.

The reaction may be carried out at temperature ranging from about 100° to about 200° C., for example from about 110° to about 170° C. The reaction may be conducted by reacting any amount of tertiary amino groups to carbonate groups sufficient to provide a quaternary ammonium compound. In one embodiment a mole ratio of tertiary amino groups to carbonate may range from 2:1 to about 1:5, or from 1:1 to 1:2, or from 1:1 to 1:1.5. The reaction may optionally be conducted in the presence of alcohol or water and excess of dialkyl carbonate. Contrary to the prior art teaching it was surprisingly found that for certain amido amines, a high yield of quaternary ammonium salt may be achieved by reacting in the absence of alcohol or water solvents and limited amounts of dialkyl carbonate. When the reaction is completed volatiles and unreacted reagents may be removed from the reaction product by heating the reaction product under vacuum. The product may be diluted with mineral oil, diesel fuel, kerosene, alcohol, or an inert hydrocarbon solvent to prevent the product from being too viscous, if necessary.

The resulting quaternary ammonium carbonate compound is then reacted with an organic acid or phenol to provide the hydrocarbyl soluble quaternary ammonium carboxylate or phenate. Specific examples of the organic acid are aliphatic, alkenyl or aromatic monocarboxylic acids such as formic acid, acetic acid, propionic acid, butyric acid, valeric acid, caproic acid, enanthic acid, caprylic acid, pelargonic acid, capric acid, undecanic acid, lauric acid, tridecanic acid, myristic acid, pentacanic acid, palmitic acid, heptadecanic acid, stearic acid, nonadecanic acid, arachidic acid, isobutyric acid, isovaleric acid, isocaproic acid, ethylbutyric acid, methyl-valeric acid, isocaprylic acid, propylvaleric acid, ethyl-caproic acid, isocapric acid, tuberculostearic acid, pivalic acid, 2,2-dimethylbutanic acid, 2,2-dimethylpentanic acid, 2,2-dimethylhexanic acid, 2,2-dimethylheptanic acid, 2,2-dimethyloctanic acid, 2-methyl-2-ethylbutanic acid, 2-methyl-2-ethylpentanic acid, 2-methyl-2-ethylhexanic acid, 2-methyl-2-propylpentanic acid, 2-methyl-2-propylhexanic acid, 2-methyl-2-propylheptanic acid, acrylic acid, crotonic acid, isocrotonic acid, 3-butenic acid, pentenic acid, hexenic acid, heptenic acid, octenic acid, nonenic acid, decenic acid, undecenic acid, dodecinic acid, tuzuic acid, physteric acid, palmitoleic acid, petroselinic acid, oleic acid, elaidic acid, vaccenic acid, gadoleic acid, methacrylic acid, 3-methylcrotonic acid, tiglic acid, methylpentenic acid, cyclopentacarboxylic acid, cyclohexanecarboxylic acid, phenylacetic acid, chloroacetic acid, glycolic acid, lactic acid, polyalkyl or polyalkenyl succinic ester acid, amide acid, imide acid. Also useful are aliphatic polycarboxylic acids such as citric acid, malonic acid, succinic acid, glutaric acid, adipic acid, pimelic acid, suberic acid, azelaic acid, sebacic acid, undecane diacid, dodecane di-acid, tridecane diacid, tetradecane diacid, pentadecane di-acid, hexadecane diacid, heptadecane diacid, octadecane diacid, nonadecane diacid, eicosane diacid, methylmalonic acid, ethylmalonic acid, propylmalonic acid, butylmalonic acid, pentylmalonic acid, hexylmalonic acid, dimethylmalonic acid, methylethylmalonic acid, diethylmalonic acid, methylpropylmalonic acid, methylbutylmalonic acid, ethylpropyl-malonic acid, dipropylmalonic acid, ethylbutylmalonic acid, propylbutylmalonic acid, dibutylmalonic acid, methylsuccinic acid, ethylsuccinic acid, 2,2-dimethylsuccinic acid, 2,3-dimethylsuccinic acid, 2-methylglutaric acid, maleic acid, citraconic acid, itaconic acid, methyleneglutaric acid, monomethyl maleate, 1,5-octanedicarboxylic acid, 5,6-decane-dicarboxylic acid, 1,7-decanedicarboxylic acid, 4,6-dimeth-yl-4-nonene-1,2-dicarboxylic acid, 4,6-dimethyl-1,2-nonane-dicarboxylic acid, 1,7-dodecanedicarboxylic acid, 5-ethyl-1,10-decanedicarboxylic acid, 6-methyl-6-dodecene-1,12-dicarboxylic acid, 6-methyl-1,12-dodecanedicarboxylic acid, 6-ethylene-1,12-dodecanedicarboxylic acid, 7-methyl-7-tetra-decene-1,14-dicarboxylic acid, 7-methyl-1,14-tetradecanedicarboxylic acid, 3-hexyl-4-decene-1,2-dicarboxylic acid, 3-hexyl-1,12-decanedicarboxylic acid, 6-ethylene-9-hexadecene-1,16-dicarboxylic acid, 6-ethyl-1,16-hexadecanedicarboxylic acid, 6-phenyl-1,12-dodecanedicarboxylic acid, 7,12-dimethyl-7,1-octadecanediene-1,18-dicarboxylic acid, 7,12-dimeth-yl-1,18-octadecanedicarboxylic acid, 6,8-diphenyl-1,14-tetradecanedicarboxylic acid, 1,1-cyclopentanedicarboxylic acid, 1,1-cyclopentanedicarboxylic acid, 1,2-cyclopentanedi-carboxylic acid, 1,1-cyclohexanedicarboxylic acid, 1,2-cyclohexanedicarboxylic acid, 4-cyclohexene-1,2-dicarboxylic acid, 5-nobornene-2,3-dicarboxylic acid, malic acid, glutamic acid, tartaric acid, and polyalkyl or polyalkenyl succinic diacids. Phenols which may be used include, but are not limited to [beta]-naphthol, o-nitrophenol, p-nitrophenol, p-aminophenol, catechol, resorcinol, 4,4'-dihydroxydiphenyl-2,2-propane, C1-C20-alkyl phenols, and polyalkyl phenols or substituted Mannich bases. The amount of acid or phenol reacted with the quaternary ammonium carbonate may range from about 10:1 to about 1:10, for example about 0.5:1 to about 2:1, or from 0.8:1 to 1.5:1 equivalents of acid or phenol per equivalent of carbonate.

One or more additional optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

When formulating the fuel compositions of this application, the additives may be employed in amounts sufficient to reduce or inhibit deposit formation in a fuel system or combustion chamber of an engine and/or crankcase. In some aspects, the fuels may contain minor amounts of the above described reaction product that controls or reduces the formation of engine deposits, for example injector deposits in engines. For example, the fuels of this disclosure may contain, on an active ingredient basis, an amount of the quaternary ammonium carboxylate in the range of about 1 mg to about 300 mg of quaternary ammonium carboxylate per Kg of fuel, such as in the range of about 5 mg to about 200 mg of per Kg of fuel or in the range of from about 10 mg to about 100 mg of the quaternary ammonium carboxylate per Kg of fuel. The active ingredient basis excludes the weight of (i) unreacted components associated with and remaining in the product as produced and used, and (ii) solvent(s), if any, used in the manufacture of the product either during or after its formation.

The additives of the present application, including the quaternary ammonium carboxylate described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of diesel, jet, or gasoline engines. The engine include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Accordingly, aspects of the present application are directed to methods for reducing friction or wear in an internal combustion engine or fuel system for an internal combustion engine as well as for reducing a corrosion potential for the fuel in the engine, fuel system or fuel terminal. In another aspect, the quaternary ammonium carboxylate compounds described herein or fuel containing the quaternary ammonium carboxylates may be combined with polyhydrocarbyl-succinimides, -acids, -amides, -esters, -amide/acids and -acid/esters, reaction products of polyhydrocarbyl succinic anhydride and aminoguanidine and its salts, and Mannich compounds.

In some aspects, the methods comprise injecting a hydrocarbon-based fuel comprising a quaternary ammonium carboxylate of the present disclosure through the injectors of the engine into the combustion chamber, and igniting the fuel. In some aspects, the method may also comprise mixing into the fuel at least one of the optional additional ingredients described above.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Carbonate Example 1

Polyisobutenylsuccinimidopropyl trimethyl ammonium methylcarbonate was prepared according to the procedure of example 4 of U.S. Pat. No. 8,147,569.

Carbonate Example 2

Method A:

Oleylamidopropyldimethylamine (125 grams) and dimethyl carbonate (123.1 grams) were charged into a 0.5 L stainless steel pressure reactor with an overhead stirrer at room temperature. The reactor was purged with nitrogen and then heated to 140° C. The reaction mixture was held at 140° C. for 6.5 hours and then cooled to give a quaternary ammonium carbonate product as a brownish liquid.

Method B:

Oleylamidopropyldimethylamine (190 grams) and dimethyl carbonate (70 grams) were charged into a 0.5 L stainless steel pressure reactor with an overhead stirrer at room temperature. The reactor was purged with nitrogen and then heated to 140° C. The mixture was held at 140° C. for 4 hours and then cooled to room temperature. 2-Ethylhexanol (31.5 grams) was added to the mixture to give quaternary ammonium carbonate product as brownish oil.

Method C:

Oleylamidopropyldimethylamine (253 grams) and dimethyl carbonate (83 grams) were charged into a 0.5 L stainless steel pressure reactor with an overhead stirrer at room temperature. The reactor was purged with nitrogen and then heated to 140° C. The mixture was held at 140° C. for 4 hours and then cooled to room temperature. 2-Ethylhexanol (31.5 grams) was added to the mixture to give quaternary ammonium carbonate product as brownish oil.

Carbonate Example 3

$C_{22}$-alkenyl succinimidopropyl dimethyl amine (which was prepared by reacting $C_{22}$-alkenylsuccinic anhydride with dimethylamino propylamine at elevated temperature to remove water) (180 grams), dimethyl carbonate (49 grams), and methanol (57.3 grams) were reacted at 140° C. in a stainless steel reactor for 6.5 hours. The resulting quaternary ammonium carbonate product was a brownish oil.

Inventive Example 1

To a round bottom flask with overhead stirrer was added oleic acid (46.4 grams) and 2-ethylhexanol (22 grams). About 1 equivalent of quaternary ammonium carbonate compound of Carbonate Example 2 was added dropwise at room temperature while the mixture was being stirred. Gas was generated during the addition of the carbonate compound. The mixture was stirred at room temperature for 4 more hours. Volatiles were then removed under rotary evaporation (90° C., 30 torr) to give a carboxylate product as a brownish oil.

Inventive Example 2

A hydrocarbyl soluble quaternary ammonium carboxylate product was made according to Inventive Example 1 except that oleic acid was replaced with 1000 Mw polyisobutenylsuccinic mono methyl ester mono acid. The product was a viscose oil.

Inventive Example 3

A hydrocarbyl soluble quaternary ammonium carboxylate product was made according to Inventive Example 1 except that oleic acid was replaced with 1000 MW polyisobutenylsuccinic mono 2-ethylhexyl ester mono acid.

Inventive Example 4

A hydrocarbyl soluble quaternary ammonium carboxylate product was made according to Inventive Example 1 except that oleic acid was replaced with 1000 Mw polyisobutenylsuccinic mono 4-methylpiperazinyl amide mono acid.

Inventive Example 5

A hydrocarbyl soluble quaternary ammonium carboxylate product was made according to Inventive Example 1 except that oleic acid was replaced with 1000 MW polyisobutenylsuccinic mono dimethylaminoethyl ester mono acid.

Inventive Example 6

A hydrocarbyl soluble quaternary ammonium carboxylate product was made according to Inventive Example 3 except that the quaternary ammonium carbonate product of Carbonate Example 3 was used.

Inventive Example 7

A hydrocarbyl soluble quaternary ammonium carboxylate product was made according to Inventive Example 6 except that acid was replaced with 1000 MW polyisobutenylsuccinic mono dimethylaminoethyl ester mono acid.

Inventive Example 8

A quaternary ammonium carbonate product was made according to Carbonate Example 3 except that the amine was replaced with dimethyl tridecyloxo-methylethyloxo-methylethyl amine to give an alkylether trimethyl quaternary ammonium compound. The hydrocarbyl soluble carboxylate product was then made according to Inventive Example 6 using the foregoing quaternary ammonium carbonate product instead of the carbonate product of Carbonate Example 3.

Inventive Example 9

To a 1000 Mw polyisobutenylsuccinic diacid (200 grams, 78 wt. % active in aromatic solvent 150) and toluene (100 grams) in a round bottom flask with an overhead stirrer was added dropwise a solution of didecyldimethyl ammonium carbonate in water (50 wt. % active, 156 grams). Water and toluene were removed under rotary evaporation (85° C., 20 torr) to give a carboxylate product as a brown oil.

Diesel Engine Test Protocol

A DW10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Various fuel additives were tested using the foregoing engine test procedure in a diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel with additive. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power at the end of a clean-up phase with the fuel additive, and power is measured according to CEC F98-08 DW10 test.

TABLE 2 in Ultra Low Sulfur Diesel Reference Fuel

| Run | Additives and treat rate (ppm by weight) | Power loss % DU | CU | Power recovery % (DU − CU)/DU × 100 | Additive Efficiency Power Recovery %/ppm |
|---|---|---|---|---|---|
| 1 | Carbonate Ex. 1 - (100 ppmw) | −6.22 | −0.78 | 87 | 0.87 |
| 2 | Inventive Ex. 9 (75 ppmw) | −6.31 | 0.26 | 104 | 1.39 |

As shown by the results in the foregoing Table 2, the additive of Inventive Example 9 provided a significant and unexpected improvement in power recovery compared to the quaternary ammonium carbonate product of Carbonate Example 1, even at a 25 wt. % lower treat rate than Carbonate Example 1. In the table, the conventional succinimide detergent is a reaction product of 1000MW PIBSA and tetraethylene pentamine (TEPA) in a mole ratio of about 1.6 to 1 as generally disclosed in U.S. Pat. No. 8,475,541.

TABLE 3 in DF-79 Reference Fuel

| Run | Additives and treat rate (ppm by weight) | Power loss % DU | CU | Power recovery % (DU − CU)/DU × 100 |
|---|---|---|---|---|
| 1 | Conventional succinimide detergent (85 ppmw) | −4.45 | −3.19 | 28 |
| 2 | Inventive Example 3 - (100 ppmw) | −4.60 | 1.72 | 137 |
| 3 | Inventive Example 4 - (100 ppmw) | −6.75 | 0.22 | 103 |
| 4 | Inventive Example 3 - (50 ppmw) plus conventional succinimide detergent (50 ppmw) | −4.56 | 1.74 | 138 |
| 5 | Inventive Example 3 - (25 ppmw) plus conventional succinimide detergent (75 ppmw) | −5.23 | 0.49 | 109 |
| 6 | Inventive Example 3 - (25 ppmw) | −3.19 | −2.09 | 34 |
| 7 | Inventive Example 7- (50 ppmw) | −4.82 | −2.2 | 54 |
| 8 | Inventive Example 7 - (50 ppmw) plus conventional succinimide detergent (50 ppmw) | −2.2 | −0.09 | 96 |
| 9 | Inventive Example 5 - (50 ppmw) plus conventional succinimide detergent (50 ppmw) | −5.45 | −0.2 | 96 |

Table 3 illustrated the fact that additives according to the disclosure are substantially more effective in increasing the power recovery, even at a lower treat rate, than a conventional succinimide detergent (Runs 6 and 7 compared to Run 1). Inventive Example 3 provided the greatest power recovery either alone (Run 2) or in combination with a convention succinimide detergent (Runs 4 and 5). All of the inventive examples, either alone (Runs 2, 3, 6 and 7) or in combination with a conventional succinimide detergent (Runs 4, 5, 8, and 9 provided an unexpected improvement in power recovery compared to a conventional succinimide detergent (Run 1). The foregoing runs also demonstrated an unexpected synergistic effect between the conventional detergent (Run 1) and Inventive Examples 3, 5 and 7 when the inventive examples were combined with the conventional succinimide detergent. For example, Run 5 provided a greater power recovery than the arithmetic sum of the power recoveries provided by Runs 1 and 6 alone. Likewise Run 8 provided a power recovery that was greater than the arithmetic sum of the power recoveries of Runs 1 and 7.

For comparison purposes, the percent flow remaining was determined in the XUD-9 engine test as shown in Table 4. The XUD-9 test (CEC F-23-01 XUD-9 method) method is designed to evaluate the capability of a fuel to control the formation of deposits on the injector nozzles of an Indirect Injection diesel engine. All XUD-9 tests were run in DF-79 reference fuel. Results of tests run according to the XUD-9 test method are expressed in terms of the percentage airflow loss at various injector needle lift points. Airflow measurements are accomplished with an airflow rig complying with ISO 4010.

Prior to conducting the test, the injector nozzles are cleaned and checked for airflow at 0.05, 0.1, 0.2, 0.3 and 0.4 mm lift. Nozzles are discarded if the airflow is outside of the range 250 ml/min to 320 ml/min at 0.1 mm lift. The nozzles are assembled into the injector bodies and the opening pressures set to 115±5 bar. A slave set of injectors is also fitted to the engine. The previous test fuel is drained from the system. The engine is run for 25 minutes in order to flush through the fuel system. During this time all the spill-off fuel is discarded and not returned. The engine is then set to test speed and load and all specified parameters checked and adjusted to the test specification. The slave injectors are then replaced with the test units. Air flow is measured before and after the test. An average of 4 injector flows at 0.1 mm lift is used to calculate the percent of fouling. The degree of flow remaining=100−percent of fouling. The results are shown in the following table.

TABLE 4

| Fuel Additive | Treat rate (ppm by weight) | 0.1 mm Lift Flow remaining (%) |
|---|---|---|
| Base fuel | NA | 23 |
| Conventional succinimide detergent (as described above in Table 3) | 50 | 33 |
| Base Fuel plus additive of Inventive Ex. 2 | 50 | 92 |
| Base Fuel plus additive of Inventive Ex. 9 | 50 | 39 |

The foregoing Table 4 illustrates the superior performance of Inventive Examples 2 and 9 in controlling the formation of deposits on fuel injectors compared to the base fuel devoid of the additive.

In the following example, the copper leachability of the additive was determined by aging copper coupons in ultra low sulfur fuel containing 10 wt. % of fatty methyl ester according to ASTM D-130. The additive treat rate in the fuel was 20 wt. % in order to accelerate the aging process. The amount of copper residue in the fuel was determined for each sample and is given in the following table.

TABLE 5

| Fuel Additive | Treat rate (weight %) | Copper (ppmw) |
|---|---|---|
| Base fuel | NA | 1 |
| Base Fuel plus additive of Carbonate Ex. 3 | 20 | 4 |
| Base Fuel plus additive of Inventive Ex. 7 | 20 | 1 |

As shown by the foregoing Table 5, Inventive Example 7 provided the same level of copper leachability as the base fuel devoid of any additive.

A demulsibility test according to ASTM D-1094 was conducted on several samples in order to determine the impact on fuel demulsibility of the reaction products in a fuel. The fuel used for the test was an ultra low sulfur diesel (ULSD) fuel having a pH buffered at 7 and including the additive at a treat rate of 200 ppmw. The fuel also contained 10 ppmw of a commercial polyglycol demulsifier. The results are shown in the following table.

TABLE 6

| Base ULSD fuel + Additive | Full Water Recovery Time | 1b Time | Separation at 5 minutes | Fuel clarity at 5 minutes |
|---|---|---|---|---|
| Carbonate Ex. 1 | Not achieved | Not achieved | 1 | 1 |
| Carbonate Ex. 2 | Not achieved | Not achieved | 3 | 4 |
| Carbonate Ex. 3 | Not achieved | Not achieved | 3 | 5 |
| Inventive Ex. 2 | 11 min. 15 sec. | 11 min. 30 sec. | 1 | 1 |
| Inventive Ex. 6 | 7 minutes | 13 min 30 sec. | 1 | 1 |

Table 6 illustrated that Inventive Examples 2 and 6 were effective, not only as detergents, but also exhibited improved demulsibility compared to the quaternary ammonium carbonate compounds of Carbonate Examples 1-3.

In the following example, a friction test was conducted using a high frequency reciprocating rig (HFRR) under a 200 gram load with a stroke distance of 1 millimeter at 50 Hz according to diesel fuel test ASTM D6079 except that the test was conducted in gasoline fuel at 25° C. The base fuel contained no additives. Each of the other fuel compositions contained a typical commercial Mannich base detergent package at 280 ppmw plus the additive being tested. The treat rate of the additive and the results are given in the following table.

TABLE 7

Fuel HFRR data

| No. | Additive | Additive Treat rate (ppmw) | HFRR Wear (micrometer) Fuel 2 |
|---|---|---|---|
| 1 | Base fuel (no additives) | 0 | 750 |
| 2 | Base fuel plus Mannich base detergent package at 280 ppmw | 0 | 755 |
| 3 | No. 2 plus a propoxylated coco-diethanolamide friction modifier | 152 | 685 |
| 4 | No. 2 plus reaction product of isostearic acid and diethanolamine | 152 | 740 |
| 5 | No. 2 plus additive of Inventive Ex 3 | 152 | 535 |

The foregoing results showed the unexpected and superior wear protection provided by Inventive Example 3 compared to fuels containing conventional amide friction modifier in a fully formulated fuel composition.

An engine test measuring fuel injector deposit (referred to as "DIG test") was performed following a procedure disclosed in Society of Automotive Engineer (SAE) International publication 2009-01-2641 "Test and Control of Fuel Injector Deposits in Direct Injected Spark Ignition Vehicles". A mathematical value of Long Term Fuel Trim (LTFT) was used to gauge the ability of additive to keep deposit from accumulating in the injectors, or to keep injectors clean. The higher the LTFT, the more deposit in the injectors and the less effective is the additive in keeping injectors clean.

The test may also be used to gauge the effectiveness of additives to clean up the injectors in a gasoline engine by running a standard 48 hour dirty up phase followed by a 48 hour clean up phase.

For the DIG test, a 2012 KIA OPTIMA equipped with a DISI 2.0 liter turbocharged I-4 engine was used. The results are shown in the following table.

TABLE 8

| Run No. | Additives and treat rate (ppm by weight) | Normalized LTFT % |
|---|---|---|
| 1 | Gasoline with typical Mannich detergent[1] (81 ppmw) | 7 |
| 2 | Fuel and additive of Run 1 plus 12 ppmw of Inventive Example 3 | <1 |

[1]Reaction product of dibutylamine, polyisobutylene cresol (1000 $MW_n$) and formaldehyde as generally described in U.S. Pat. No. 7,491,248.

Table 8 illustrated that Inventive Example 3 also provided superior injector clean up properties in a gasoline fuel composition compared to a fuel containing only a conventional Mannich detergent.

It is noted that, as used in this specification and the appended claims, the singular forms "a," "an," and "the,"

include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel additive composition for a fuel injected engine comprising a fuel additive component and a hydrocarbyl soluble quaternary ammonium carboxylate derived from a reaction of a quaternary ammonium carbonate with an organic acid having a molecular weight of at least about 282 g/mol, wherein the quaternary ammonium carbonate is formed by reacting a carbonic acid diester with a tertiary amido amine compound.

2. The fuel additive composition of claim 1, wherein the quaternary ammonium carbonate is selected from the group consisting of succinimidoalkyl trialkyl ammonium carbonates, succinamido/succinyl ester ammonium carbonates and amidoalkyl trialkyl ammonium carbonates.

3. The fuel additive composition of claim 1, wherein the organic acid is selected from the group consisting of stearic acid, nonadecanoic acid, arachidic acid, tuberculostearic acid, tuzuic acid, petroselinic acid, oleic acid, elaidic acid, vaccenic acid, gadoleic acid, polyalkyl or polyalkenyl succinic ester acid, amide acid, imide acid, hexadecane diacid, heptadecane diacid, octadecane diacid, noncadecane diacid, eicosane diacid, 3-hexyl-4-decene-1,2-dicarboxylic acid, 3-hexyl-1,12-decanedicarboxylic acid, 6-ethylene-9-hexadecene-1,16-dicarboxylic acid, 6-ethyl-1,16-hexadecanedicarboxylic acid, 6-phenyl-1,12-dodecanedicarboxylic acid, 7,12-dimeth-y-7,1-octadecanediene-1,18-dicarboxylic acid, 7,12-dimeth-yl-1,18-octadecanedicarboxylic acid, 6,8-diphenyl-1,14-tetradecanedicarboxylic acid, and polyalkyl or polyalkenyl succinic diacids.

4. The fuel additive composition of claim 1, wherein from about 0.5 to about 2.0 equivalents of acid are reacted per equivalent of quaternary ammonium carbonate.

5. The fuel additive composition of claim 1, wherein the fuel additive component is selected from the group consisting of a carrier fluid, a cetane improver, an octane improver, a fuel detergent, a demulsifier, an antioxidant, and a combination of two or more of the foregoing.

6. A fuel composition comprising the fuel additive of claim 1, wherein the amount of hydrocarbyl soluble quaternary ammonium carboxylate ranges from about 5 to about 300 ppm based on a total weight of the fuel composition.

7. A diesel fuel composition comprising the fuel additive of claim 1, wherein the amount of hydrocarbyl soluble quaternary ammonium carboxylate ranges from about from about 10 to about 200 ppm based on a total weight of the fuel composition, and wherein the fuel composition exhibits injector cleaning attributes and full water recovery and an interface rating of 1b in a demulsibility test according to ASTM D-1094.

8. The fuel additive of claim 1, wherein the quaternary ammonium carbonate is made by reacting an amidodialkylamine with dialkylcarbonate in the mole ratio of amine to carbonate of from about 1:1 to about 1:1.5 at a temperature ranging from about 120° to about 160° C. in a reaction medium devoid of alcohol, wherein the quaternary ammonium carbonate is a hydrocarbyl substituted amido-trialkyl quaternary ammonium carbonate.

9. The fuel additive composition of claim 1, wherein the quaternary ammonium carbonate is formed by reacting a carbonic acid diester with a tertiary amido amine compound of the following formula

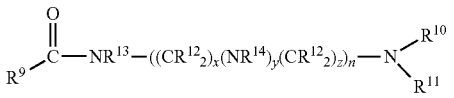

wherein each of $R^{10}$, and $R^{11}$ is selected from hydrocarbyl groups containing from 1 to 200 carbon atoms, each $R^9$, $R^{12}$, $R^{13}$ and $R^{14}$ is independently selected from hydrogen or a hydrocarbyl group, x is 1 to 6, y is 0 or 1, z is 1 to 6, and n is 1 to 6.

10. A method of improving the injector performance of a fuel injected engine comprising operating the engine on a fuel composition comprising a major amount of fuel and from about 5 to about 300 ppm by weight based on a total weight of the fuel composition of a hydrocarbyl soluble quaternary ammonium carboxylate derived from a reaction of a quaternary ammonium carbonate with an organic acid having a molecular weight of at least about 282 g/mol, wherein the quaternary ammonium carbonate is formed by reacting a carbonic acid diester with a tertiary amido amine compound.

11. The method of claim 10, wherein the engine is selected from the group consisting of a direct fuel injected diesel engine and a direct fuel injected gasoline engine.

12. The method of claim 10, wherein the quaternary ammonium carbonate is selected from the group consisting of succinimidoalkyl trialkyl ammonium carbonates, succinamido/succinyl ester ammonium carbonates and amidoalkyl trialkyl ammonium carbonates.

13. The method of claim 10, wherein the organic acid is selected from the group consisting of stearic acid, nonadecanoic acid, arachidic acid, tuberculostearic acid, tuzuic acid, petroselinic acid, oleic acid, elaidic acid, vaccenic acid, gadoleic acid, polyalkyl or polyalkenyl succinic ester acid, amide acid, imide acid, hexadecane diacid, heptadecane diacid, octadecane diacid, noncadecane diacid, eicosane diacid, 3-hexyl-4-decene-1,2-dicarboxylic acid, 3-hexyl-1,12-decanedicarboxylic acid, 6-ethylene-9-hexadecene-1,16-dicarboxylic acid, 6-ethyl-1,16-hexadecanedicarboxylic acid, 6-phenyl-1,12-dodecanedicarboxylic acid, 7,12-dimeth-y-7,1-octadecanediene-1,18-dicarboxylic acid, 7,12-dimeth-yl-1,18-octadecanedicarboxylic acid, 6,8-diphenyl-1,14-tetradecanedicarboxylic acid, and polyalkyl or polyalkenyl succinic diacids.

14. The method of claim 10, wherein the fuel composition contains from about 10 to about 200 ppm of the quaternary ammonium carboxylate based on a total weight of the fuel composition.

15. A method of reducing wear in a fuel system of an engine comprising combusting in the engine a fuel composition comprising a major amount of fuel and from about 5 to about 300 ppm by weight based on a total weight of the fuel composition of a hydrocarbyl soluble quaternary ammonium carboxylate derived from a reaction of a quaternary ammonium carbonate with an organic acid having a molecular weight of at least about 282 g/mol, wherein the quaternary ammonium carbonate is formed by reacting a carbonic acid diester with a tertiary amido amine compound.

16. The method of claim 15, wherein the fuel composition further comprises a fuel additive component selected from the group consisting of a carrier fluid, a cetane improver, an octane improver, a fuel detergent, a demulsifier, an antioxidant, and a combination of two or more of the foregoing.

17. The method of claim 15, wherein the quaternary ammonium carbonate is selected from the group consisting of succinimidoalkyl trialkyl ammonium carbonates, succinamido/succinyl ester ammonium carbonates and amidoalkyl trialkyl ammonium carbonates.

18. The method of claim 15, wherein the organic acid is selected from the group consisting of stearic acid, nonadecanoic acid, arachidic acid, tuberculostearic acid, tuzuic acid, petroselinic acid, oleic acid, elaidic acid, vaccenic acid, gadoleic acid, polyalkyl or polyalkenyl succinic ester acid, amide acid, imide acid, hexadecane diacid, heptadecane diacid, octadecane diacid, noncadecane diacid, eicosane diacid, 3-hexyl-4-decene-1,2-dicarboxylic acid, 3-hexyl-1,12-decanedicarboxylic acid, 6-ethylene-9-hexadecene-1,16-dicarboxylic acid, 6-ethyl-1,16-hexadecanedicarboxylic acid, 6-phenyl-1,12-dodecanedicarboxylic acid, 7,12-dimeth-y-7,1-octadecanediene-1,18-dicarboxylic acid, 7,12-dimeth-yl-1,18-octadecanedicarboxylic acid, 6,8-diphenyl-1,14-tetradecanedicarboxylic acid, and polyalkyl or polyalkenyl succinic diacids.

19. A method of improving the demulsibility of a fuel composition comprising providing as a fuel composition a major amount of fuel and from about 5 to about 300 ppm by weight based on a total weight of the fuel composition of a hydrocarbyl soluble quaternary ammonium carboxylate derived from a reaction of a quaternary ammonium carbonate with an organic acid having a molecular weight of at least about 282 g/mol, wherein the quaternary ammonium carbonate is formed by reacting a carbonic acid diester with a tertiary amido amine compound.

20. The method of claim 19, wherein the quaternary ammonium carbonate is selected from the group consisting of succinimidoalkyl trialkyl ammonium carbonates, succinamido/succinyl ester ammonium carbonates and amidoalkyl trialkyl ammonium carbonates.

21. The method of claim 19, wherein the organic acid is selected from the group consisting of stearic acid, nonadecanoic acid, arachidic acid, tuberculostearic acid, tuzuic acid, petroselinic acid, oleic acid, elaidic acid, vaccenic acid, gadoleic acid, polyalkyl or polyalkenyl succinic ester acid, amide acid, imide acid, hexadecane diacid, heptadecane diacid, octadecane diacid, noncadecane diacid, eicosane diacid, 3-hexyl-4-decene-1,2-dicarboxylic acid, 3-hexyl-1,12-decanedicarboxylic acid, 6-ethylene-9-hexadecene-1,16-dicarboxylic acid, 6-ethyl-1,16-hexadecanedicarboxylic acid, 6-phenyl-1,12-dodecanedicarboxylic acid, 7,12-dimeth-y-7,1-octadecanediene-1,18-dicarboxylic acid, 7,12-dimeth-yl-1,18-octadecanedicarboxylic acid, 6,8-diphenyl-1,14-tetradecanedicarboxylic acid, and polyalkyl or polyalkenyl succinic diacids.

* * * * *